US006702657B2

(12) United States Patent
Ficarro

(10) Patent No.: US 6,702,657 B2
(45) Date of Patent: Mar. 9, 2004

(54) CONTINUOUS POLISHER MACHINE

(76) Inventor: Daniel A. Ficarro, 1200 Keyon Rd., Ontario, NY (US) 14519

( * ) Notice: Subject to any disclaimer, the term of this patent is extended or adjusted under 35 U.S.C. 154(b) by 225 days.

(21) Appl. No.: 10/040,607

(22) Filed: Jan. 9, 2002

(65) Prior Publication Data

US 2003/0129932 A1 Jul. 10, 2003

(51) Int. Cl.[7] ..... B24B 5/00

(52) U.S. Cl. ..... 451/270; 451/271; 451/288; 451/291

(58) Field of Search ..... 451/280, 288, 451/385, 398, 270, 271, 287, 290, 291

(56) References Cited

U.S. PATENT DOCUMENTS 3,813,828 A * 6/1974 Bennett ..... 451/28
5,647,789 A * 7/1997 Kitta et al. ..... 451/41
5,975,986 A * 11/1999 Allen et al. ..... 451/5
6,074,275 A * 6/2000 Yashiki et al. ..... 451/5
6,093,088 A * 7/2000 Mitsuhashi et al. ..... 451/285
6,113,490 A * 9/2000 Hakomori ..... 451/288
6,206,767 B1 * 3/2001 Suzuki et al. ..... 451/262
6,296,554 B1 * 10/2001 Lai et al. ..... 451/271
6,338,669 B1 * 1/2002 Togawa et al. ..... 451/36
6,458,012 B1 * 10/2002 Hirokawa et al. ..... 451/5
6,530,827 B2 * 3/2003 Mitsuhashi ..... 451/72
6,579,148 B2 * 6/2003 Hirokawa et al. ..... 451/5

* cited by examiner

*Primary Examiner*—M. Rachuba
(74) *Attorney, Agent, or Firm*—Shlesinger, Fitzsimmons & Shlesinger

(57) ABSTRACT

The frame of a polishing machine has a disc-shaped polishing table mounted thereon for rotation coaxially about a vertical axis, the table having thereon an upper, generally planar polishing surface for removably supporting thereon a plurality of annular workpiece carriers for rotation therewith and for rotation about their repsective axes relative to the table. The outer peripheral surface of each carrier is disposed to be engaged at angularly spaced points thereabout by a pair of rollers mounted on the frame for rotation about spaced, vertical axes. The output of a single AC electric motor is connected to the table to effect rotation thereof about its vertical axis, and to one roller of each pair thereof to drive the one roller about its axis. The one roller of each such pair thereof is in driving, rolling engagement with the carrier engaged thereby, while the other roller of such pair is rotated by the engaged carrier.

16 Claims, 4 Drawing Sheets

CONTINUOUS POLISHER MACHINE

BACKGROUND OF THE INVENTION

This invention relates to machines for polishing the surface or surfaces of workpieces, such as for example workpieces made of glass, ceramic, silicon crystals and metals. Even more particularly this invention relates to an improved such polishing machine which eliminates the need for employing a plurality of different drive motors to effect various operations of the polisher.

There are currently available in the marketplace a number of machines for polishing products such as those made from glass, ceramic, silicon crystals and metals. U.S. Pat. No. 4,916,868, for example discloses a honing, lapping or polishing machine which utilizes three disc-shaped work holders each having therein a series of circular apertures for holding workpieces, and with the discs being mounted for rotation about their respective axes and also for revolution within a surrounding, circular gear type member. One disadvantage of this mechanism is that it requires a plurality of separate electric motors for driving various parts on the machine. U.S. Pat. No. 6,045,716 also discloses a plurality of carrier devices for holding workpieces, and which carrier devices are operated independently of each other. This is typical in most prior polishing machines in which the various work carriers are driven by a plurality of independently operated DC motors.

It is an object of this invention, therefore, to provide for a polishing machine improved drive means which utilizes a single electric motor for simultaneously rotating a polishing table, and a plurality of removable workpiece holders mounted on a polishing surface of the table for rotation therewith and for rotation relative thereto.

Another object of this invention is to provide improved drive means of the type described which rotates workpiece holders and the polishing table in the same direction about their axes.

A still further object of this invention is to provide for a machine of the type described improved, circular workpiece holders retained for rotation about stationary vertical axes during rotation of the table upon which they are mounted.

Other objects of the invention will be apparent from the specification and from the recital of the appended claims particularly when read in conjunction with the accompanying drawings.

SUMMARY OF THE INVENTION

A disc-shaped polishing table, which is mounted on a machine frame for rotation by an AC electric motor coaxially about a vertical axis, has thereon an upper, generally planar polishing surface for supporting for rotation thereon a plurality of circular workpiece carriers. A plurality of rigid arms are supported on the frame above the table to extend radially inwardly thereof in angularly spaced relation to each other, and in vertically spaced relation to the polishing surface. A pair of rollers are supported on each of the arms for rotation therebeneath about spaced, vertical axes, and for rolling engagement with the outer peripheral surface of one of said carriers at angularly spaced points thereabout. One roller of each pair thereof is operatively connected to the table to be rotated thereby, and is in rolling, driving engagement with one of said carriers to effect rotation thereof while the other roller of the pair is rotated by the carrier with which it is engaged. Also, each of the carriers is annular in configuration and has a disc-shaped workpiece holder removably mounted coaxially therein to be seated on the polishing surface, and each holder has therethrough spaced openings for accommodating the ends of the workpieces that are to be polished.

THE DRAWINGS

DETAILED DESCRIPTION OF THE PREFERRED EMBODIMENTS

Figure 3:
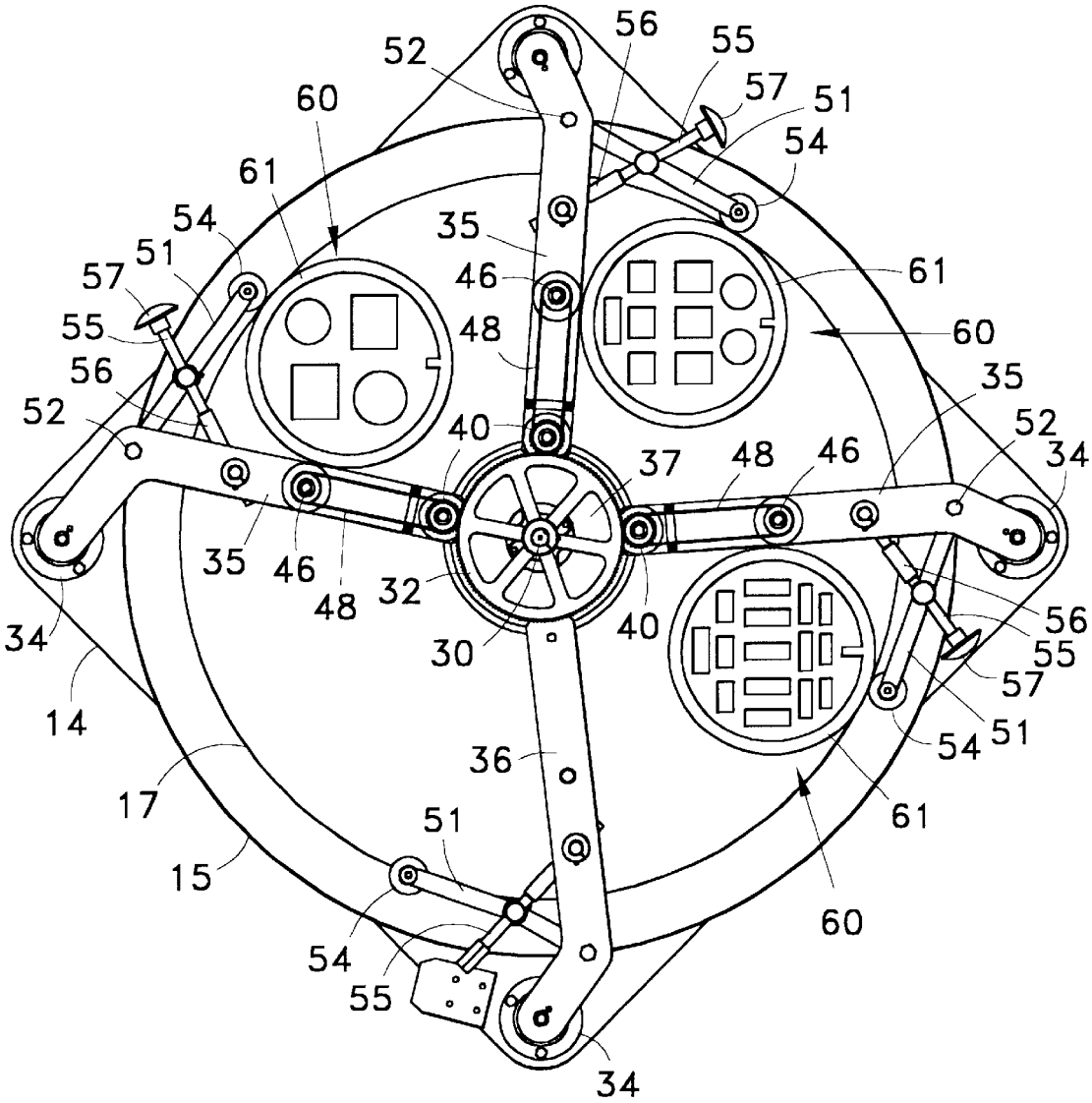
FIG. 3 is a plan view of the machine as shown in FIG. 1, illustrating the carrier rings which are employed in the three work stations on the machine.
Figure 4:
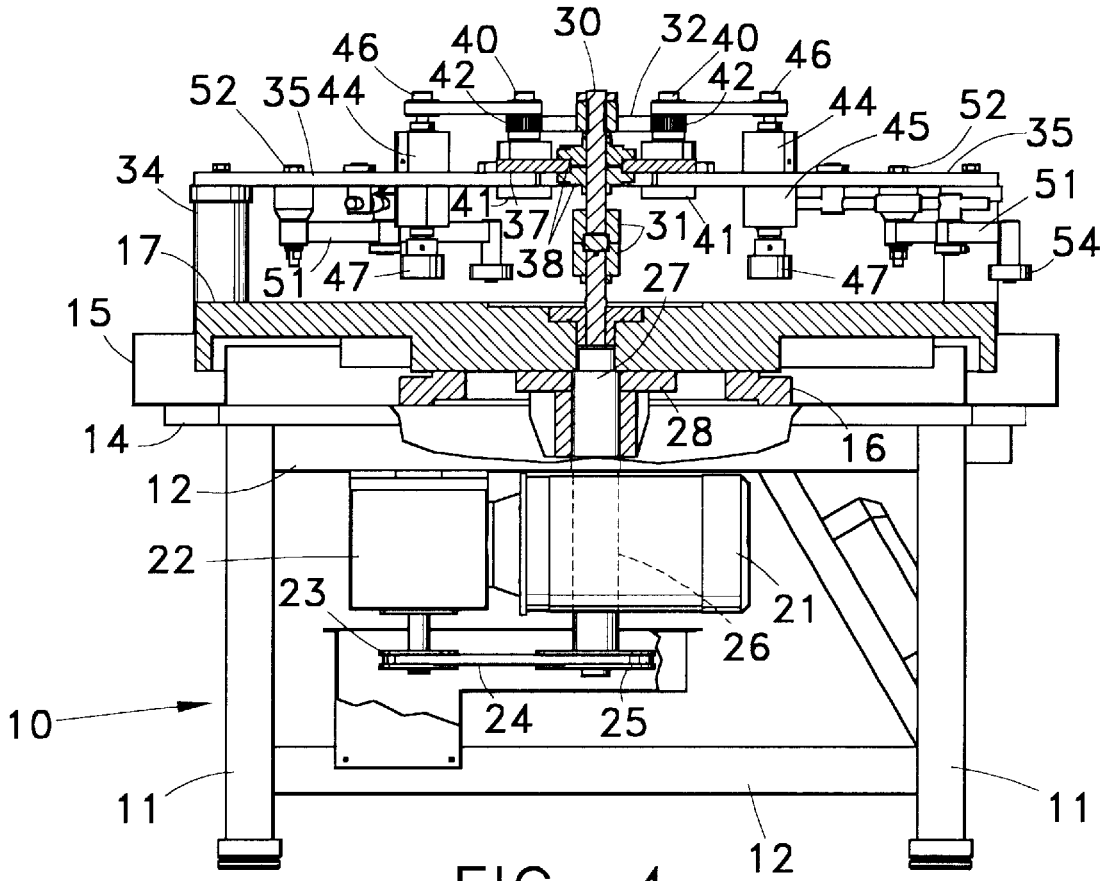
FIG. 4 is an elevational view of one side of the machine with portions of the upper half of the view shown in section to illustrate in greater detail the drive mechanism for the carrier rings.

Referring now to the drawings by numerals of reference and initially to FIGS. 2, 3 and 4, 10 denotes generally a rectangular frame or base made of metal, or the like, and having on each of its four corners vertical leg sections 11 equal in length and interconnected by horizontally disposed beams 12. Fixed to the upper ends of the legs 11 of the base 10 is a rigid, rectangularly shaped top plate 14. Secured at the bottom thereof on plate 14 centrally thereof is a circular recovery tank, which is annular in cross section, as shown in FIG. 4, and which has an outside diameter slightly larger than the width of the top plate 14. Secured centrally on the upper surface of top plate 14, and disposed in radially spaced, coaxial relation to the inside diameter of the annular tank 15 is a circular bearing assembly 16 (FIG. 4). Supported on its lower end on the circular bearing assembly 16 for rotation coaxially thereof is a large, heavy, generally disc-shaped granite or cast iron table 17, which has a diameter slightly less than the outside diameter of tank 15, and which has thereon a plane, flat upper surface covered with a material or fluid for polishing as noted hereinafter.

Referring now to FIG. 4, supported by the cross beams 12 adjacent one side of frame 10 is an AC electric motor 21 having an output shaft (not illustrated) drivingly connected to a single speed reducer 22 of conventional design, such as offered for sale by Boston Gear. The output shaft of reducer 22 is connected to a pulley 23, which in turn is connected by a V-belt 24 to another pulley 25 that is secured to the lower end of a shaft 26 which is mounted in frame 10 for rotation coaxially of table 17. Shaft 26 is drivingly connected to the lower end of a spindle assembly drive shaft 27, the upper end of which extends through a registering opening in plate 14, and part way into a central opening in table 17. Intermediate its ends the spindle drive shaft 27 has integral therewith and coaxially thereof, an enlarged-diameter spindle plate 28, which extends through a registering opening in the top plate 14, and is bolted or otherwise secured against the underside of table 17 coaxially thereof, so that any rotation imparted to the shaft 26 is also imparted to table 17.

The upper end of the spindle assembly drive shaft 27, which projects into the central opening in the table 17, is drivingly connected coaxially to the lower end of a reduced-diameter sun gear shaft 30 which, as shown in FIG. 4, extends vertically above the upper surface of table 17 and coaxially through a coupling member 31. Secured coaxially to shaft 30 adjacent the upper end thereof is a large spur gear 32, which functions as a sun gear for driving a plurality of smaller spur gears as noted in greater detail hereinafter.

Secured at their lower ends to the upper surface of table 17 adjacent each of its four corners, and projecting vertically upwardly equidistantly above the upper surface of table 17 are four, cylindrically shaped pillar assemblies 34. Secured to the upper end of each pillar assembly 34 is the slightly offset end of one of four, similar, rigid arms, three of which are denoted by numerals 35 and one by numeral 36. The opposite ends of arms 35 and 36 project horizontally and radially inwardly over the face of plate 17 and part way toward the center thereof at approximately 90° intervals about its centerline. At their inner ends the arms 35 and 36 are secured to the underside of a circular sun plate 37 having therethrough a central, circular opening in which are secured a pair of flanged, annular bearings 38 through the centers of which the sun gear shaft 30 extends rotatably and coaxially. Each of three, identical gear shafts 40 is rotatably mounted adjacent one end thereof in a circular opening formed adjacent the inner end of each of the three arms 35 by a pair of circular bearings 41 (FIGS. 2 and 4) secured to the upper and lower surfaces, respectively, of a respective arm 35. Each shaft 40 projects vertically above its bearings 41 in radially spaced parallel relation to shaft 30, and has secured to its upper end a small spur gear 42. The teeth of the spur gears 42 are in driving, meshing engagement with the teeth of the sun gear 32.

Intermediate its ends each of the three arms 35 has secured to opposite sides thereof, and in coaxial registry with each other, a pair of circular bearing blocks 44 and 45, the axial bores of which register coaxially with a circular opening in the respective arm 35. Rotatably mounted in the registering bores of each pair of bearing blocks 44 and 45, and extending rotatably through the registering opening in the associated arm 35 is a drive roller shaft 46, which projects coaxially beyond opposite ends of the associated pair of bearings 44 and 45. Secured to the lower end of each shaft 46 is a drive roller 47 which is employed, as noted hereinafter, for driving a workpiece carrier ring. A pulley which is fixed to the upper end of each shaft 46 is connected by a timing belt 48 to a like pulley which is secured to the upper end of the associated gear shaft 40 that is rotatably mounted in the inner end of the associated arm 35. In this manner, when motor 21 drives shafts 26 and 30 and hence gear 32 in, for example, a counterclockwise direction as shown in FIG. 3, then the spur gears 42 drive shafts 40, and hence belts 48, shafts 46 and rollers 47 thereon in a clockwise direction. Moreover, all shafts 46 and their drive rollers 47 are thus rotated at the same speed.

Each of four rather small, rigid, straight arms 51 is pivotally connected at one end thereof to the lower end of one of four bolts 52, each of which is secured adjacent its upper end in one of the arms 35 and 36 adjacent its slightly offset outer end. Rotatably mounted on the opposite end of each arm 51 for rotation slightly therebeneath about an axis that extends parallel to the axis in a rotation of table 17, is a nylon guide roller 54. Intermediate its ends each arm 51 is pivotally coupled to a threaded scissor rod 55 intermediate the ends thereof. Each rod 55 adjustably threads at its inner end into an internally threaded rod coupling 56 (FIGS. 1 and 3), which is pivotally connected at its inner end to the associated arm 35, 36, and which in the case of the arms 35 has secured to its outer end a circular, palm grip head 57 for manually rotating the associated rod 55 selectively in opposite directions. Rods 55 associated with the arms 35 normally prevent any pivotal movement of the arms 51 to which they are connected, but can be manually rotated to cause the associated arms 51 to adjust their respective guide rollers 54 inwardly or outwardly relative to the outer peripheral surface of the table 17.

Figure 5:
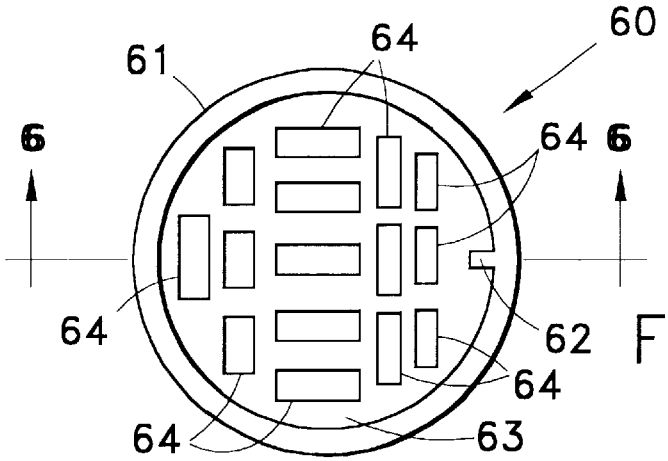
FIG. 5 is a detail plan view of one type of workpiece carrier ring employed with this invention.
Figure 6:
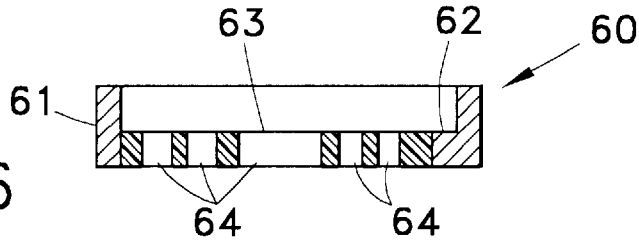
FIG. 6 is a sectional view taken generally along the line 6—6 in FIG. 5 and looking in the direction of the arrows.

Referring now to FIGS. 5 and 6, 60 denotes generally one type of workpiece carrier ring which is adapted to be employed with the polishing machine disclosed herein. Each ring 60 comprises an outer, metallic ring 61 having an integral, generally rectangularly-shaped key 62 protecting radially inwardly from its inner peripheral surface adjacent one end thereof. Removably mounted coaxially in one end of the ring 61, the lower end as shown in FIG. 6, is a circular, generally disc-shaped layer 63 of plastic material, such as Lexan, which has in its outer peripheral surface a rectangularly-shaped notch for accommodating the key 62 on the ring 61. Layer 63 has therethrough a plurality of spaced openings 64, which in the embodiment illustrated in FIG. 6 happen to be illustrated in rectangular configurations, but as shown in FIG. 3 can be of any desired shape which would be suitable for accommodating the workpieces that are to be polished.

In use, as shown for example in FIG. 3, three of the carrier rings 60 are placed upon the table 17 with the outer, metal ring 16 of each carrier ring having its outer peripheral surface engaged both with the drive roller 47 that rotates beneath one of the arms 35, and also, at another point on its peripheral surface with the nylon guide roller 54 carried by the arm 51 which is pivotally mounted at its opposite end to the associated arm 35. Thus, when the electric motor 21 drives the sun gear 32 in a counterclockwise direction, as illustrated in FIG. 3, the drive rollers 47 rotate the three carrier rings 60 that are engaged therewith also in a counterclockwise direction about stationary vertical axes, so that as the surface of the table 17 rotates beneath the carriers 60 the metal rings 61 and hence the plastic layers 63 that are drivingly connected to the rings 61 by the keys 62, are likewise rotated by the associated surrounding ring 61, and at the same rpm. Although not shown specifically in FIG. 3, the apertures in the disc-shaped layers 63 are disposed to have releasably disposed therein the correspondingly-shaped ends of glass items or the like, the bottom surfaces of which are engaged directly with the polishing material disposed on the upper surface of the table 17. Therefore the plane bottom surfaces of such workpieces (not illustrated) would be exposed to the polishing materials on the face of the table 17, and also would be rotated relative to the table 17 as its rotates beneath the carrier rings 60. The motion of table 17 tends to urge each of the carrier rings 60 into engagement with the rollers 47 and 54 that are supported by the associated arm 35 so that each ring 61 is rotated by virtue of the frictional engagement of its outer peripheral surface with one of the drive rollers 47. The associated rotatable guide roller 54, as noted above, can be adjusted in a somewhat radial direction relative to the outer peripheral surface of the table 17, so that the relative position of a particular carrier ring 60 can be adjusted with respect to the rollers 47 and 54 engaged therewith.

Figure 1:
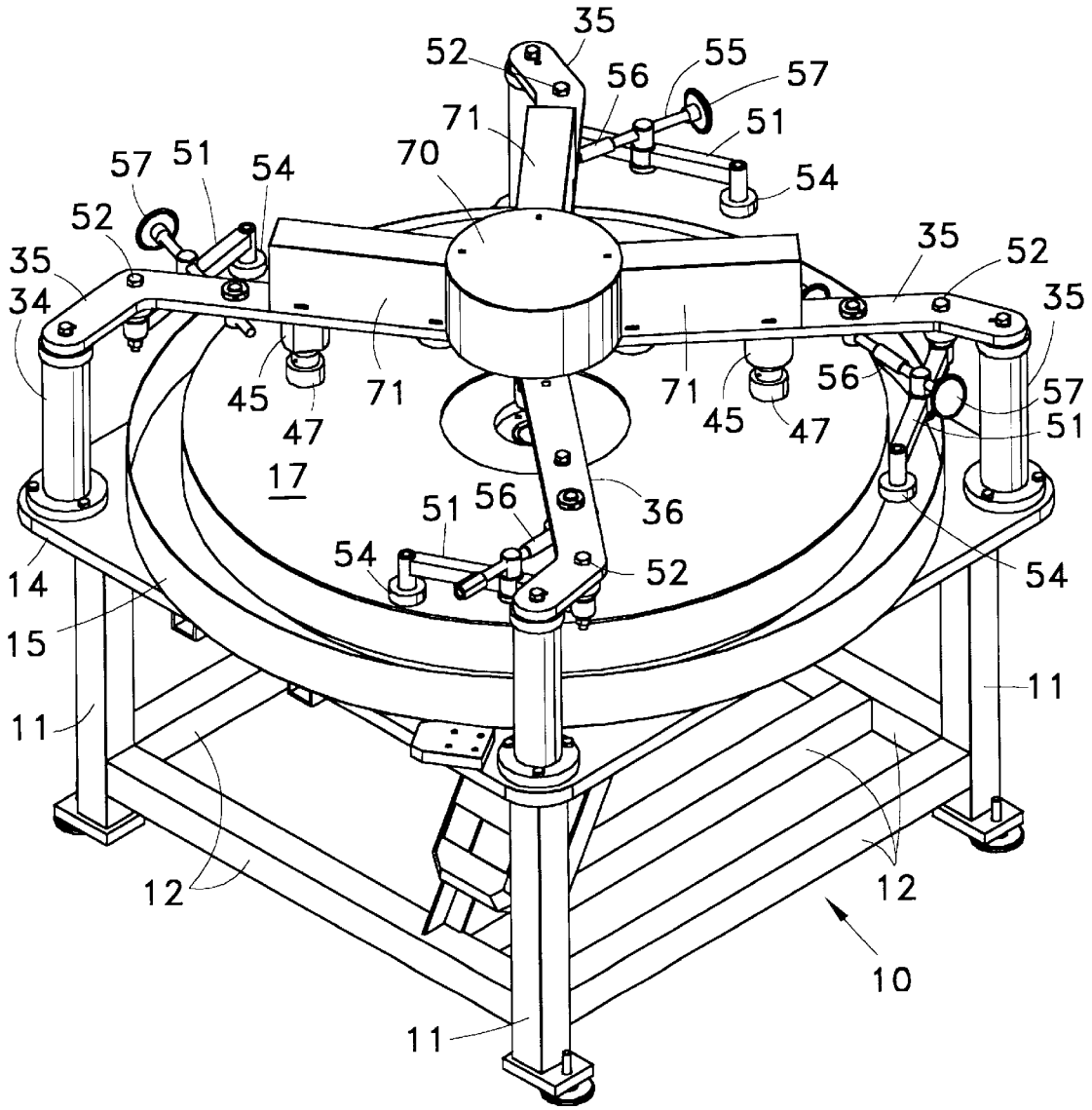
FIG. 1 is a perspective view of a continuous polisher machine made according to one embodiment of this invention.
Figure 2:
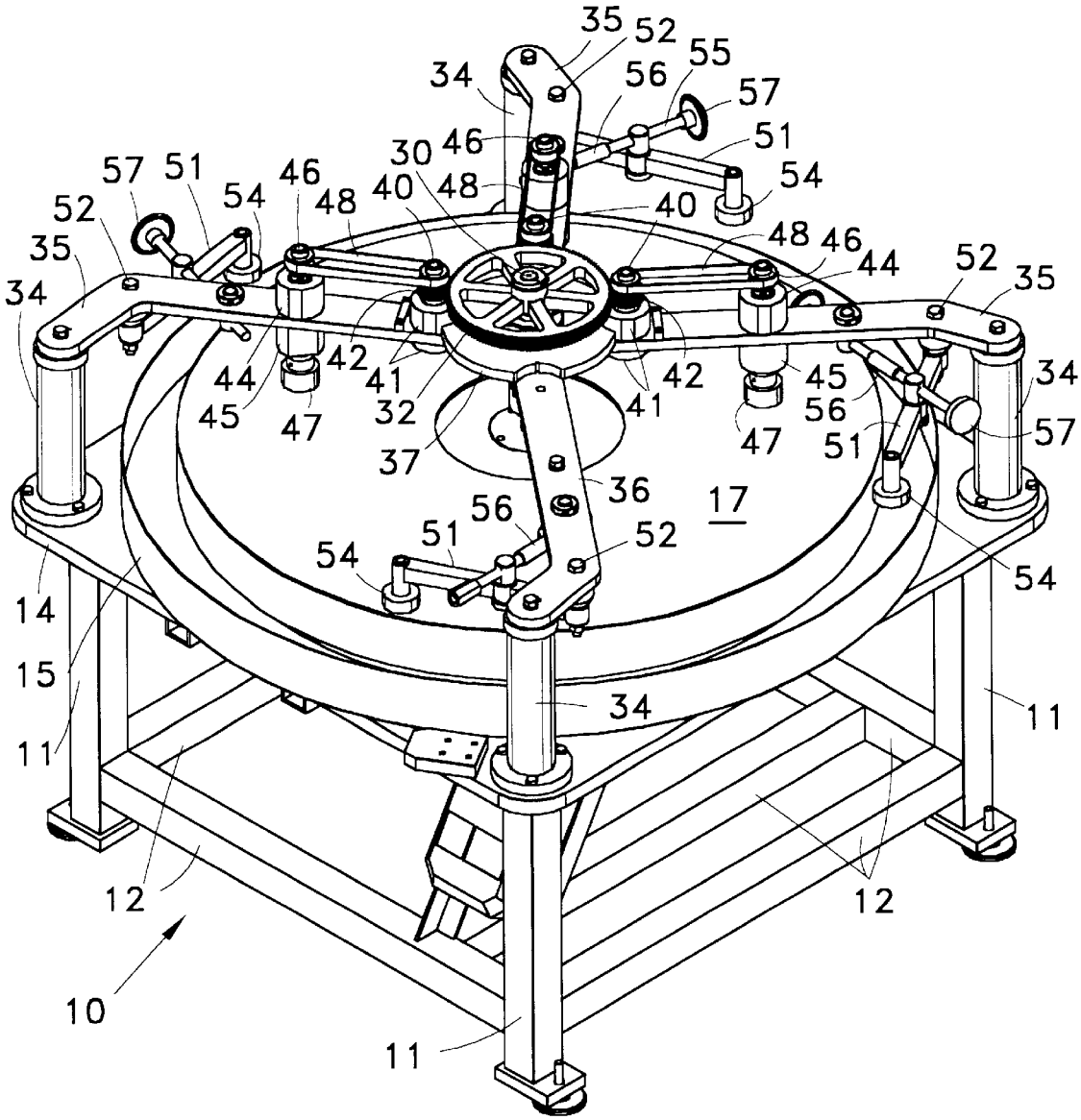
FIG. 2 is a perspective view similar to FIG. 1, but with several of the covers shown in FIG. 1 removed to illustrate in greater detail the three drive mechanisms which are employed for driving workpiece carrier rings as noted hereinafter.

As shown in FIG. 1, before placing the machine 10 in use, it is customary to enclose the sun gear 32 and upper end of its drive shaft 30 in a circular housing 70 which is supported on the inner ends of arms 35 and 36. Also, each of three, similar, generally rectangularly shaped housings 71 is mounted on a different one of the three arms 35 to overlie and enclose the timing belt 48 and pulleys of the associated arm 35.

While this invention has been illustrated and described in connection with only certain embodiments thereby, it will be apparent that it is capable of still further modification, and that this application is intended to cover any such modifications which fall within the scope of one skilled in the art or the appended claims.

What is claimed is:

1. A machine for polishing workpieces, comprising a frame having a disc-shaped polishing table mounted thereon for rotation coaxially about a vertical axis, said table having thereon an upper, generally planar polishing surface for supporting for rotation thereon a plurality of circular workpiece carriers, means connected to said table and operable to rotate said table in a predetermined direction about said axis, a main shaft secured to and projecting coaxially above said table for rotation therewith in said predetermined direction, a plurality of rigid arms supported on said frame above said table to extend radially inwardly of said table in angularly spaced relation to each other, and over said upper surface of said table, in vertically spaced relation thereto, each of said arms having a carrier drive shaft mounted therein for rotation about an axis extending parallel to and radially spaced from the axis of said table, each of said drive shafts having an upper end extending above and a lower end extending beneath the respective arm in which it is mounted, drive means connecting the upper ends of said drive shafts to said main shaft for rotation thereby in unison, and a drive roller secured to the lower end of each of said drive shafts and disposed to be engaged with one of said circular workpiece carriers to impart rotation thereto relative to said table.

2. A machine as defined in claim 1, wherein said drive rollers are operative to rotate said carriers about their respective axes in the same direction of rotation as said table.

3. A machine as defined in claim 1, wherein said drive shafts are rotated by said drive means in directions opposite to the direction of rotation of said table.

4. A machine as defined in claim 1, wherein said workpiece carriers are annular in configuration, and each of said drive rollers is disposed to have rolling, driving engagement with the outer peripheral surface of one of said carriers.

5. A machine as defined in claim 4, including means mounting a rotatable guide roller on each of said arms for rotation about an axis spaced from and parallel to the axis of rotation of the associated drive roller mounted on the same arm, each of said guide rollers being disposed to have rolling engagement with the outer peripheral surface of one of said carriers at a point angularly spaced from the point thereon engaged by said associated drive roller.

6. A machine as defined in claim 5, wherein said guide roller mounting means includes means for adjusting the space separating the axes of rotation of the drive roller and guide roller mounted on a respective one of said arms.

7. A machine as defined in claim 1, wherein said drive means comprises a main spur gear secured to said main shaft coaxially thereof and for rotation thereby, a second shaft mounted in each of said arms for rotation about an axis spaced form and extending parallel to the axis of said main shaft and to the axis of the associated drive shaft mounted in the same arm, a further spur gear secured coaxially to each of said second shafts with the teeth thereof meshing with the teeth of said main spur gear, whereby said second shafts are rotated in unison by said main spur gear, and means for transmitting the rotation of each of said second shafts to said drive shaft of the associated arm.

8. A machine as defined in claim 7, wherein said means for transmitting the rotation of each of said second shafts to said drive shaft of the associated arm comprises a belt and pulley mechanism.

9. A machine as defined in claim 1, including a plurality of said circular workpiece carriers removably supported on said polishing surface of said table, each of said carriers being annular in configuration and having a disc-shaped workpiece holder removably mounted coaxially in the respective carrier seated on said polishing surface, each of said workpiece holders having therethrough at least one opening for removably accommodating the end of a workpiece that is to be polished by said polishing surface of said table, and means for transmitting the rotation of said carriers to said holders.

10. A machine as defined in claim 9, wherein each of said disc-shaped workpiece holders has a recess in its outer peripheral surface, and said means for transmitting the rotation of said carriers to said holders comprises a key projecting from the inner peripheral surface of each of said carriers and removably into said recess in the associated holder mounted therein.

11. A machine as defined in claim 1, wherein said means operable to rotate said table comprises, an AC electric motor mounted on said frame beneath said table, and means including a speed reducer drivingly connecting the output shaft of said motor to said table to effect rotation of said table and said main shaft.

12. A machine for polishing workpieces, comprising a frame having a disc-shaped polishing table mounted thereon for rotation coaxially about a vertical axis, said table having thereon an upper, generally planar polishing surface, drive means for rotating said table in a predetermined direction about said axis, a plurality of rigid arms supported on said frame above said table to extend radially inwardly of said table in angularly spaced relation to each other, and over said upper surface of said table, in vertically spaced relation thereto, means for supporting a plurality of annular workpiece carriers on said polishing surface of said table for rotation therewith beneath said arms, and for rotation about their respective axes relative to said table, said means comprising a pair of rollers supported on each of said arms for rotation therebeneath about spaced, parallel axes, and for rolling engagement with the outer peripheral surface of one of said carriers at angularly spaced points thereabout, and means connecting one of said pair of rollers on each of said arms to said drive means for rotation thereby, said one roller of each pair thereof being in rolling, driving engagement with one of said carriers, and the other roller of said pair being rotatable by said one carrier.

13. A machine as defined in claim 12, wherein said one rollers are operative to rotate said carriers about their respective axes in the same direction of rotation as said table.

14. A machine as defined in claim 12, wherein said one rollers are rotated by said drive means in directions opposite to the direction of rotation of said table.

15. A machine as defined in claim 12, including means for adjusting the space separating the axes of rotation of said rollers of each pair thereof.

16. A machine as defined in claim 12, including a disc-shaped workpiece holder removably mounted coaxially in each of said carriers for rotation therewith about the axis of the surrounding carrier, and each of said holders having therethrough at least one opening for removbly accommodating an end of a workiece that is to be polished by said polishing surface of said table.

* * * * *